US006640982B1

(12) United States Patent
Bjerke

(10) Patent No.: US 6,640,982 B1
(45) Date of Patent: Nov. 4, 2003

(54) ADJUSTABLE PLASTIC BAG DRYING RACK

(76) Inventor: Mary A. Bjerke, 2508 33rd St. SW., Fargo, ND (US) 58103

( * ) Notice: Subject to any disclaimer, the term of this patent is extended or adjusted under 35 U.S.C. 154(b) by 0 days.

(21) Appl. No.: 10/292,077

(22) Filed: Nov. 12, 2002

(51) Int. Cl.[7] ..... A47G 29/00
(52) U.S. Cl. ..... 211/85.15
(58) Field of Search ..... 211/85.15, 12; 248/95, 96, 97

(56) References Cited

U.S. PATENT DOCUMENTS

| | | | | | |
|---|---|---|---|---|---|
| 746,988 | A | * | 12/1903 | Olin | 248/97 |
| 3,295,694 | A | | 1/1967 | Nejezchleb et al. | 211/126 |
| 4,856,206 | A | | 8/1989 | Klein | 34/151 |
| 5,080,237 | A | * | 1/1992 | Hefner | 211/85.15 |
| 5,102,076 | A | | 4/1992 | North et al. | 248/95 |
| 5,188,244 | A | | 2/1993 | Hollstegge | 211/71 |
| 5,190,252 | A | * | 3/1993 | Schrager | 248/97 |
| 5,247,752 | A | | 9/1993 | Gyr et al. | 34/239 |
| 5,303,827 | A | * | 4/1994 | Ross | 211/85.15 |
| 5,405,018 | A | * | 4/1995 | Anthrop, Jr. | 211/41.9 |
| 5,421,542 | A | | 6/1995 | Crutcher | 248/95 |
| 5,641,137 | A | | 6/1997 | Collier | 248/95 |
| 5,797,567 | A | * | 8/1998 | Magnafici | 248/97 |
| 5,901,861 | A | | 5/1999 | Huguet | 211/85.15 |
| 6,012,687 | A | * | 1/2000 | Head | 248/100 |
| 6,116,549 | A | * | 9/2000 | Santa Cruz et al. | 248/97 |
| 6,164,607 | A | * | 12/2000 | Hawkes | 248/97 |
| 6,243,967 | B1 | | 6/2001 | Dovolas | 34/103 |
| 6,267,334 | B1 | * | 7/2001 | Siu | 248/97 |
| 6,367,492 | B1 | | 4/2002 | Brown | 134/166 |

* cited by examiner

*Primary Examiner*—Alvin Chin-Shue
*Assistant Examiner*—Sarah Purol
(74) *Attorney, Agent, or Firm*—Curtis Harr

(57) ABSTRACT

This plastic bag drying apparatus is comprised of a rectangularly shaped tray having front and rear tine assemblies which are comprised of a laterally oriented pivotally mounted tine bases. The inner portions of the tine bases are equipped with a plurality of bag tines that extend perpendicularly therefrom in a manner so that extend in a parallel fashion away from the center of rotation defined by the tine bases. The positions of the tine assemblies with respect to one another spaces the individual bag tines so that the distance between those positioned on the front tine assembly with respect to those on the rear tine assembly equals the width of the plastic storage bags to be dried.

13 Claims, 4 Drawing Sheets

FIG 2
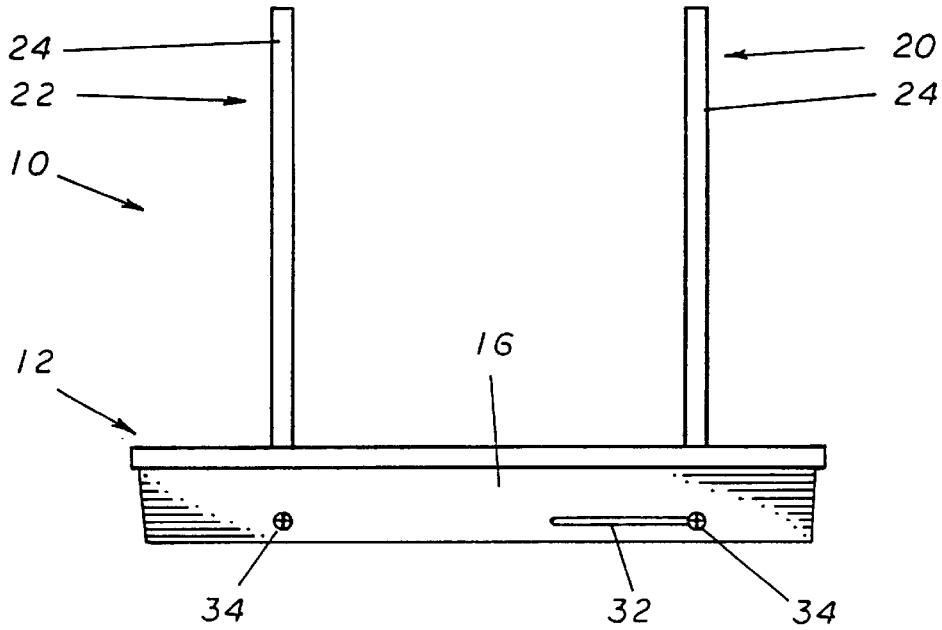
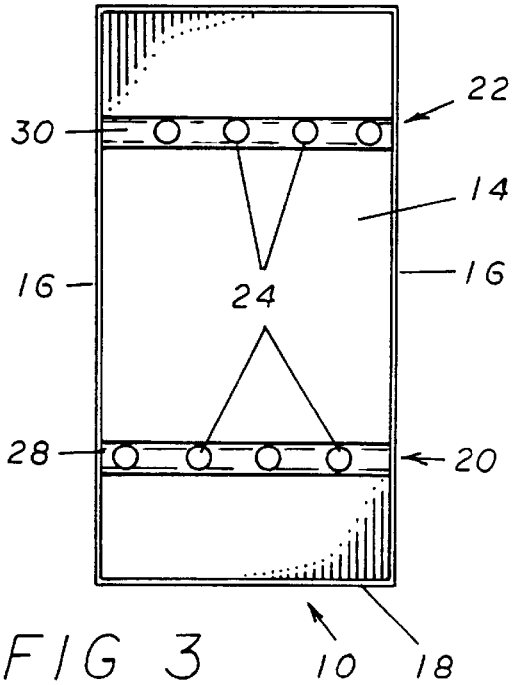
FIG 3
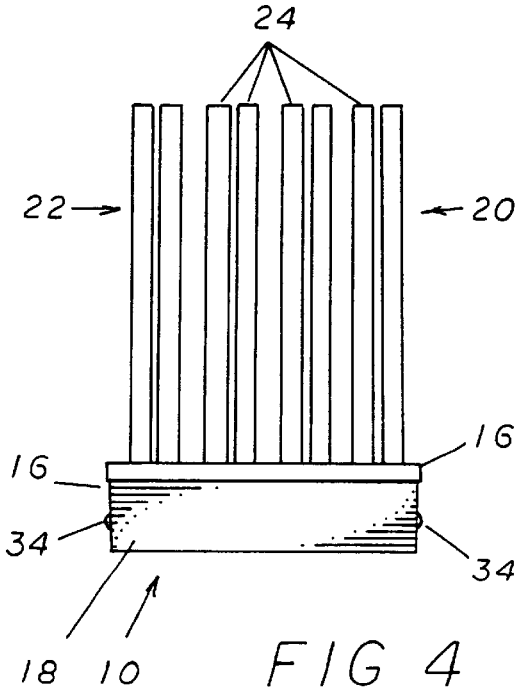
FIG 4

FIG 5
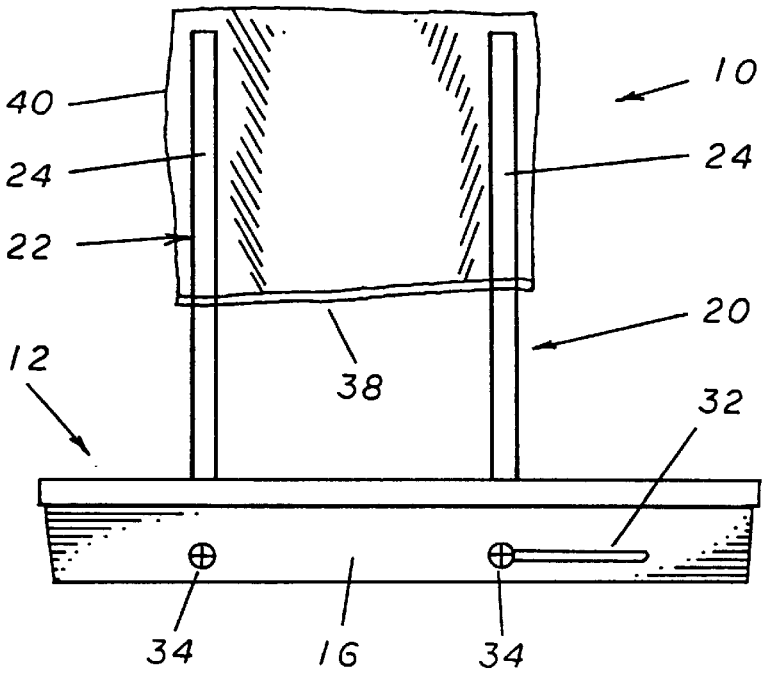
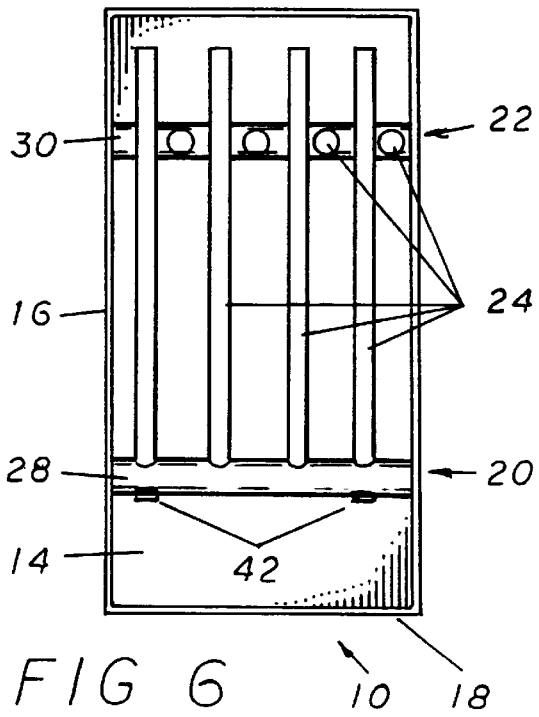
FIG 6
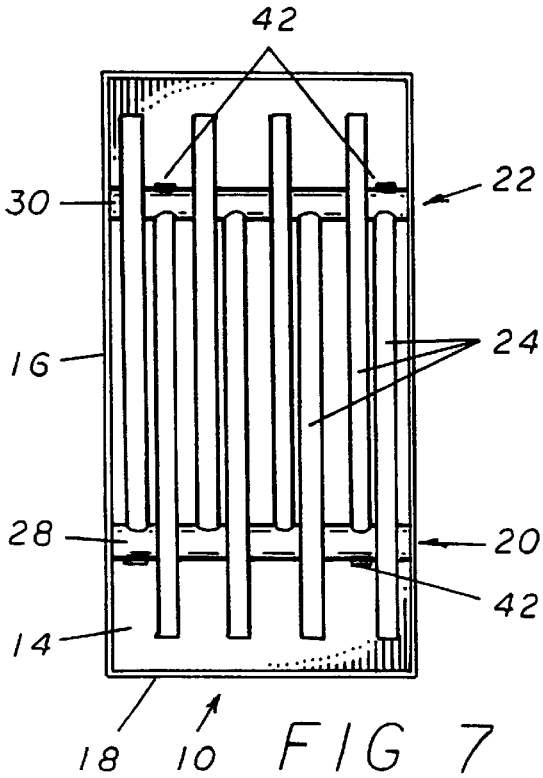
FIG 7

FIG 8
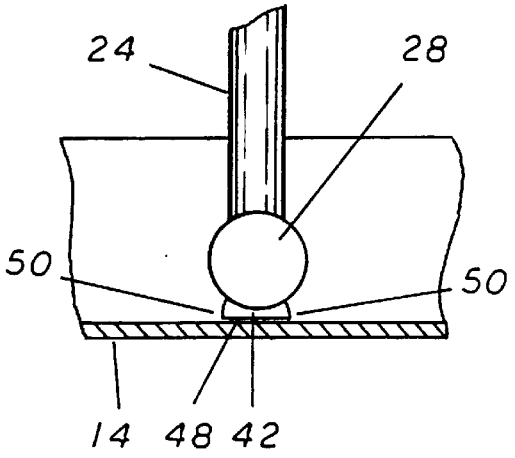
FIG 9
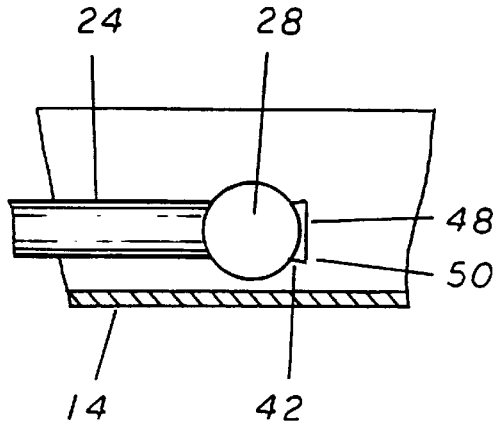
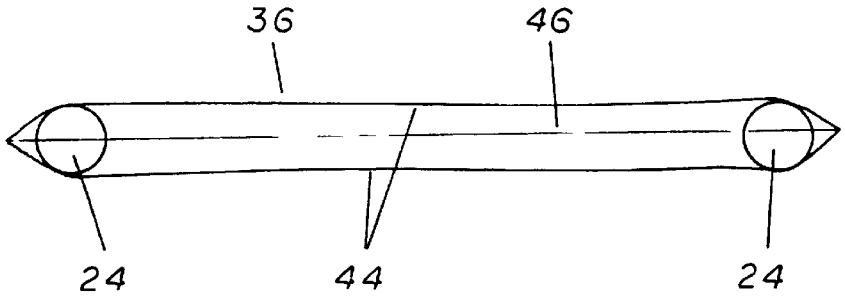
FIG 10

ADJUSTABLE PLASTIC BAG DRYING RACK

BACKGROUND OF THE INVENTION

The present invention relates to an improvement in the methods used to dry plastic storage bags for later reuse after washing. More specifically, to an adjustable mechanism which provides a means by which a variety of different sized storage bags can by positioned in an inverted and open orientation to allow for the complete drying of both the inner and outer surfaces of the bags. Thus, the present invention enables them to be reused thereby lessening the costs to the consumer and the stress placed on the land fill systems by reducing the amount of waste the average household produces.

The use of plastic storage bags in households across the world has become very common place today. These bags are typically constructed of thin durable and transparent plastic sheets that are sealed together on three edges forming a pouch having a re-sealable closing mechanism generally consisting of a zipper employed to close off the open end of the bag. This configuration provides a convenient mechanism by which such items as leftover and pre-prepped food stuffs, bulk purchased foods, fish and game, and a plethora of other similar small items can be sealed and stored for later use. Additionally, the resealing capability of these bags enhances their utility in these uses as it allows the user to remove partial amounts of their contents, reseal the bag, and return the remainder to the refrigerator or other storage device.

The major problem associated with the use of these plastic storage bags stems from their re-sealable, and therefore reusable, nature. The difficulty associated with the design is that on the initial use small food particles or liquids tend to adhere to the inner surfaces of the plastic bags. The presence of this organic material can lead to the growth of bacteria and other pathogens which renders them unsafe and therefor unuseable. A solution to this problem is to wash all surfaces of the bags to remove this material prior to reusing them. However, because of the thin and flexible nature of the plastic used to construct them it is very difficult to dry them thoroughly as the sides of the bags tend to stick together. This situation severely restricts the flow of air within the bags and leads to a continually damp environment which again is conducive to the of pathogens which renders the bags useless.

The prior art has numerous examples of devices that are offered to make plastic storage bags reusable by providing a means by which they can be effectively dried after washing. The first of these is U.S. Pat. No. 3,295,694 issued to Nejezchleb et al. which provides a horizontally oriented shallow tray having a plurality of vertically positioned hoops extending from its upper surface. The lower and open ends of the hoops fit within corresponding holes in the upper surface of the tray and their position relative to the tray is adjustable through the use of an alternative set of holes. With the hoops properly positioned, the washed bags are inverted and placed over the hoops to dry. The problem with this design is that the hoops are only adjustable to very specific positions relative to the tray which limits its effectiveness with the large variety of plastic storage bag sizes on the market today.

Another example in the prior art is U.S. Pat. No. 5,188,244 issued to Hollstegge which illustrates a bag drying apparatus comprised of a flat rectangular block having a plurality of rods extending vertically from its upper face.

The upper ends of these rods are fitted with a horizontally oriented bar designed to fit into the bottom of the bags when they are inverted and placed on the device for drying. The first of the problems associated with this design is there is no mechanism to collect excess water dripping from the bags during the drying process. Secondly, there is no mechanism to ensure the sides of the bags don't touch while the bags are drying. These design flaws result in water pooling around its base which must be constantly cleaned up and a situation in which the interior of the bags may never totally dry due to the sides of the bags touching during the drying process. This results in a situation which is conducive to the growth of pathogens thereby destroying the usefulness of washing the bags.

A third example of these types of apparatuses in the prior art is illustrated in U.S. Pat. No. 5,641,137 issued to Collier illustrating a bag drying rack comprised of a plurality of pairs of centrally pivoting rods that have a pair of bases fixed to their lower ends. The apparatus is employed by pivoting the bases away from one another forming a stable platform from which the pairs of rods extends upwards in a X-like manner. The upper ends of these rods then form the portion of the device over which the inverted bags are placed for drying. Similar in its flaws to the device described directly above, there is no drip water collector resulting in pooling water below it and it has no mechanism to keep the sides of the bags completely separated resulting in similar dying deficiencies.

Therefore, it can be seen that it would be desirable to provide a mechanism for drying plastic storage bags in a manner that allows the interior of the bags to dry completely so that they may be reused for storage of food stuffs and other similar items. Additionally, that it would be advantageous to provide a plastic storage bag drying device that would both collect and contain the water dripping from the bags and keep the sides of the bags from touching so the interior dries completely facilitating their reuse.

SUMMARY OF THE INVENTION

It is the primary objective of the present invention to provide a mechanism which will allow consumers to reuse their plastic storage bags by enabling them to be completely dried after washing ensuring that no residue from the previous contents remains on any surface of the bag and rendering them safe to use for any purpose for which they were suitable when new.

It is an additional objective of the present invention to provide such a mechanism which is equipped with a base configured in the shape of a tray functioning to collect and contain the water dripping from the drying bags thereby avoiding the pooling of water around the base of the invention and eliminating the need for constant attention and cleanup.

It is a further objective of the present invention to provide a bag drying mechanism which allows them to be partially stretched when inverted and placed on the invention ensuring the adjacent sides will not come into contact with one another and enabling the interior of the plastic bags to dry completely resulting in a storage container that is completely free of pathogens and therefore safe to reuse.

These objectives are accomplished by the use of a rectangularly shaped tray having a floor with vertically oriented sides extending upwards along its longer edges and corresponding edges along its shorter edges. This forms a shallow opened topped tray having the purpose of collecting the water that drips from the surfaces of the plastic storage bags as they dry on the upper portions of the present invention. Additionally, the vertical sides of the base also provide the pivotal mounting points for the front and rear tine assemblies providing the point of placement for the washed plastic storage bags for the drying process.

The front and rear tine assemblies are comprised of a laterally oriented (with respect to the invention's base) pivotally mounted tine bases. The mounting of these bases is accomplished by the use of a pair of mounting screws that extend through from the outside of the base sides and engage on either end of the tine bases. Additionally, this attachment is made in such a manner so that it leaves the tine bases free to rotate around their point of connection with the attachment screws.

The inner portions of the tine bases are then also equipped with a plurality of bag tines extending perpendicularly therefrom in a manner so that they extend in a parallel manner (in respect to one another) away from the center of rotation defined by the tine bases. The rotational aspect of the tine bases allows the bag tines to be rotated to either a perpendicular orientation with respect to the rack base when configured for bag drying or to a parallel orientation with respect to the rack base when the invention is configured for storage.

In the construction of the present invention the interior of the rack base is equipped with a pair of tine assemblies positioned generally on opposite ends of the base. Additionally, the positions of the tine assemblies with respect to one another spaces the individual bag tines so that the distance between the bag tines on the front tine assembly with respect to those on the rear tine assembly equals the width of the plastic storage bags. This positioning of the bag tines is critical to the operation of the present invention as it allows the plastic storage bags to placed on the bag tines in a manner stretching them to the degree so that their sides do not touch during the drying process. This allows air to pass freely through the interior of the plastic bags ensuring that they will thoroughly dry and be safe for later reuse.

The front tine assembly is also equipped with a mechanism which allows the distance between the front tine assembly and the rear tine assembly to be varied. This is accomplished through the use of an adjustment slot that is cut into the side of the rack base through which the tine base screws pass in the attachment process of the front tine assembly. By sliding the front tine assembly along the length of these adjustment slots, thus, varying the distance between the front and rear tine assemblies, the present invention can be used effectively with a wide variety of plastic storage bags on the market today.

The pivotal nature of the tine assemblies is facilitated by the use of a plurality of positioning tabs located on the surface of the tine bases that is opposite of the bag tines themselves. The positioning tabs are extensions of the tine bases that are flattened on their lower surfaces. These flattened surfaces are employed to engage the upper surface of the base floor when the bag tines have been raised to their perpendicular orientation for bag drying. This is accomplished due to the fact that the positioning tabs resist the rotation of the tine bases when the tine assemblies are in the perpendicular orientation which can only be overcome by the use of an external rotational force placed on the outer ends of the bag tines. This manner of construction creates a stable platform upon which a plurality of plastic storage bags can be placed to ensure their adequate drying for safe reuse.

For a better understanding of the present invention reference should be made to the drawings and the description in which there are illustrated and described preferred embodiments of the present invention.

DESCRIPTION OF THE DRAWINGS

FIG. 2 is a side elevation view of the present invention illustrating the orientation front and rear tine assemblies when they are in their raised position relative to the base rack for bag drying purposes.

FIG. 3 is a top elevation view of the present invention illustrating the orientation front and rear tine assemblies when they are in their raised position relative to the base rack for bag drying purposes.

FIG. 4 is a front elevation view of the present invention illustrating the orientation front and rear tine assemblies when they are in their raised position relative to the base rack for bag drying purposes.

FIG. 5 is a side elevation view of the present invention illustrating the orientation of the tine assemblies when the front tine assembly is moved forward within the adjustment slot facilitating the use of the invention with plastic storage bags of varying sizes.

FIG. 6 is a top elevation view of the present invention illustrating its configuration when the front tine assembly has been rotated into the parallel position, relative to the rack base, for storage purposes and detailing the relative lateral positions of the bag tines on the front tine assembly and those on the rear tine assembly.

FIG. 7 is a top elevation view of the present invention illustrating its configuration when both the front tine assembly and the rear tine assembly have been rotated into the parallel positions, relative to the rack base, for storage purposes and detailing their relative lateral positions.

FIG. 8 is a side elevation cut-away view of the front tine base component of the present invention which details the configuration of the tine assembly positioning tabs and their orientation when the tine assembly is in the raised or perpendicular position and illustrating the manner in which they engage the base floor to hold the tine assembly in the desired orientation.

FIG. 9 is a side elevation cut-away view of the front tine base component of the present invention which details the orientation of the tine assembly positioning tabs when the tine assembly is in the lowered or parallel position allowing the invention to be easily stored.

FIG. 10 is a top elevation view of a pair of bag tines having a plastic storage bag placed over them for drying and illustrating the manner in which the tines keep the plastic sides of the bag from coming into contact with one another during the drying process.

DESCRIPTION OF THE PREFERRED EMBODIMENT

Figure 1:
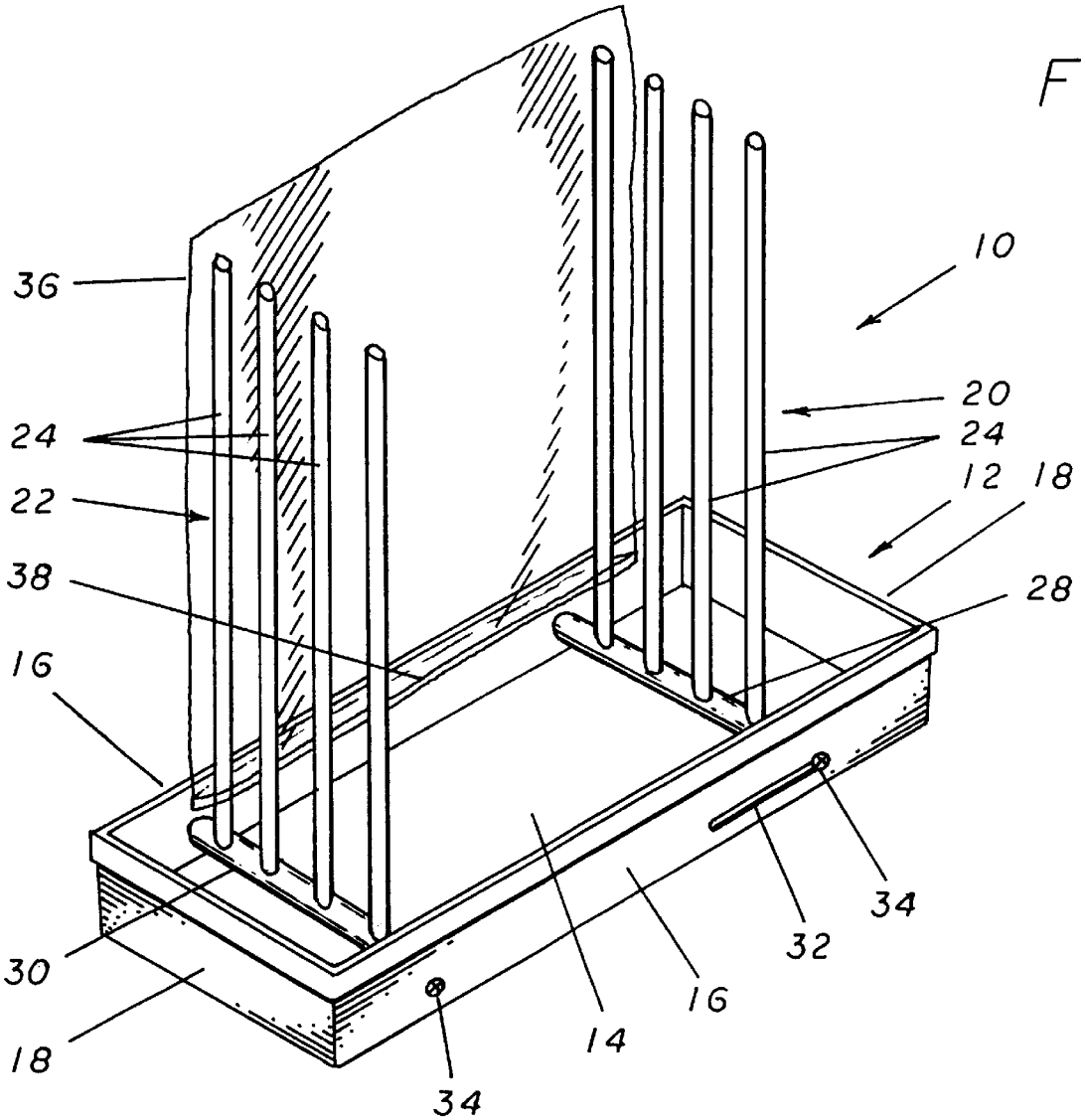
FIG. 1 is a perspective view of the present invention which illustrates the manner in which the bag tines are employed to stretch a plastic storage bag over the rack base in order to ensure that a washed bag is completely dried to facilitate its safe reuse.

Referring now to the drawings, and more specifically to FIGS. 1, 2, 3, and 4, the adjustable bag drying rack 10 is comprised of a generally rectangular rack base 12 having a base floor 14 that forms the bottom of a tray-like apparatus. The outside edges of the base floor 14 are connected on the long side of the rectangle to the base sides 16 which extend vertically upwards from their point of attachment. Additionally, the short sides of the rectangle formed by the base floor serve as the point of attachment for the base ends 18 which also extend upwards and are in turn connected to the corresponding edges of the base sides 16. This manner of construction results in the rack base 12 being formed into a shallow tray which functions to catch and collect the water dripping from the drying bag thereby eliminating such water from pooling around the rack base 12 and creating the problems associated with the collection of unwanted water on kitchen surfaces.

The rack base 12 also serves as the point of attachment for the front adjustable tine assembly 20 and the rear tine assembly 22. The front adjustable tine assembly 20 and the rear tine assembly 22 are the components of the present invention that are employed to secure a plastic storage bag (in the case of this FIGURE a large plastic bag 36 is illustrated) in the proper orientation to ensure that it dries properly. The securement of the large plastic bag 36 is facilitated by the use of the plurality of bag tines 24 that form the major components of the front adjustable tine assembly 20 and the rear tine assembly 22 and are positioned during use in a perpendicular fashion with respect to the rack base 12. The bag tines 24 are oriented in the front adjustable tine assembly 20 and the rear tine assembly 22 so that the large plastic bag 36 can be fitted over a bag tine 24 on the front adjustable tine assembly 20 and a corresponding bag tine 24 on the rear tine assembly 22 by inverting the large plastic bag 36 and passing the bag opening 38 over the respective bag tines 24. This allows any water remaining in the large plastic bag 36 after washing to drip into the rack base 12 where it is maintained until the owner chooses to empty it and remove the dried large plastic bag 36.

The manner in which the large plastic bag 36 is placed on the bag tines 24 for the drying process and this method of placement is further detailed in FIG. 10. It is critical for the reuse of these storage bags that they are thoroughly cleaned and dried after their initial use. To accomplish this, the bag sides 44 must be kept in a position so that they do not come into contact with one another during the drying process. With this in mind, the present invention is designed so that the bag tines 24 can be placed in relation to one another so that the large bag 36 is stretched between them to a degree that results in the bag sides 44 being relatively flat and parallel and creating an interior space 46 between them. The interior space 46 is crucial to the drying process as it allows for the free flow of air within the large plastic bag 36 which ensure's that it will dry completely thereby eliminating the possibility of the later growth of pathogens that tend to flourish in, areas of high moisture and poor ventilation.

The attachment of the front adjustable tine assembly 20 is accomplished by the use of the front tine base 28 which is a cylindrical apparatus that corresponds in length to the distance between the base sides 16 of the rack base 12. The front tine base 28 is then attached within the rack base 12 by the use of a pair of tine base screws 34 that pass from the outer surface of the base sides 16 into either end of the front tine base 28. This attachment is made in a fashion that allows the front tine base 28 to rotate freely enabling the front adjustable tine assembly 20 to pivot around the connection facilitated by the tine base screws 34.

Additionally, the point at which the tine base screws 34 pass through the base sides 16 forms an adjustment slot 32. The adjustment slot 32 allows the position of the front adjustable tine assembly 20 relative to the rack base 12 to slide either forwards or rearwards which has the effect of shortening or lengthening the distance between itself and the rear tine assembly 22. This provides a degree of flexibility to the present invention that allows it to be used in a plurality of different applications.

The adjusting ability through the use of the adjustment slot 32 is further illustrated in FIG. 5 which details the use of the present invention with a small plastic bag 40. In this configuration, the front adjustable tine assembly 20 is moved rearward towards the rear tine assembly 22 by sliding the front adjustable tine assembly 20 in the desired direction. Once the proper location has been obtained, the tine positioning tabs 42 hold the front adjustable tine assembly 20 in place. With the positioning of the front adjustable tine assembly 20 and the rear tine assembly 22 completed, the small plastic bag 40 can be positioned for drying by inverting it and sliding it over a pair of corresponding bag tines 24. This positioning of the small plastic bag 40 acts in the exact manner as with the large plastic bag 36 as described above in that its sides are kept from touching during the drying process ensuring that it will dry completely making it safe for reuse at a later time.

The present invention is also capable of being collapsed by rotating the front adjustable tine assembly 20 and the rear tine assembly 22 down and towards the center of the rack base 12 which is detailed in FIGS. 6 and 7. This capability is facilitated by the manner in which the front and rear tine bases, 28 and 30, are pivotally attached to the rack base 12 by the use of the tine base screws 34. This attachment is made in a manner so that the tine base screws 34 do not cinch the ends of the front and rear tine bases, 28 and 30, against the interiors of the base sides 16. This allows the front and rear tine bases, 28 and 30, to freely rotate around these pivotal attachments which in turn allows the front adjustable tine assembly 20 and rear tine assembly 22 to be rotated between the perpendicular and parallel positions enabling the present invention to be collapsed for easy storage.

Additionally, the bag tines 24 are positioned on the front rear tine bases, 28 and 30, in a manner so that those positioned on the front adjustable tine assembly 20 are slightly offset in their lateral aspect relating to the rack base 12. to those positioned on the rear tine assembly 22. This configuration means that when the front adjustable tine assembly 20 and the rear tine assembly 22 are rotated into the parallel position, the bag tines 24 of each will fit into the gaps or on the sides of their opposite. This configuration facilitates the collapsing of the present invention as it provides the space for the bag tines 24 to pass one another in the rotation process while not affecting the positioning of the large or small plastic bags, 36 and 40, during the drying function. The collapsing ability of the present invention enhances its utility as it allows it to be stored in a small area while providing a simple mechanism by which it can be configured in the open position for it intended use.

Finally, the front and rear tine bases, 28 and 30, are also equipped with a plurality of tine assembly positioning tabs 42 on their lower surfaces when the front adjustable tine assembly 20 and the rear tine assembly 22 are in their perpendicular position the construction and operation of which are illustrated in FIGS. 8 and 9. The tine assembly positioning tabs 42 are protrusions of the front and rear tine bases, 28 and 30, which have a flattened lower surface 48 used to engage the base floor 14 to hold the front adjustable tine assembly 20 and the rear tine assembly 22 in the perpendicular position while the invention is in use. This is accomplished due to the fact that the tine assembly positioning tabs 42 resist the rotation of the front and rear tine bases, 28 and 30, when the front adjustable tine assembly 20 and the rear tine assembly 22 are in their perpendicular orientation. This resistance is due to the fact that the corners 50 of the tine assembly positioning tabs 42 are configured so that they resist rotational force within the front adjustable tine assembly 20 and the rear tine assembly 22. This resistence of the tine assembly positioning tabs 42 can only be overcome by the use of an external rotational force placed on the outer ends of the bag tines 24. This manner of construction creates a stable platform upon which a plurality of plastic storage bags can be placed to ensure their adequate drying for safe reuse.

Although the present invention has been described in considerable detail with reference to certain preferred versions thereof, other versions are possible. Therefore, the spirit and scope of the appended claims should not be limited to the description of the preferred versions contained herein.

What is claimed:

1. A bag drying rack comprising:

a tray shaped rack base having a floor, a left and right side and a front and back end;

a front and rear cross bar pivotally attached to said left and right side of said tray shaped rack; and a plurality of bag tines extending perpendicular from said front and rear cross bar.

2. A bag drying rack as in claim 1 wherein said left and right side of said tray forms a first and second elongate slot such that said front cross bar may slide within said first and second elongate slot.

3. A bag drying rack as in claim 2 further comprising a plurality of fasteners to attach said cross bars to said tray.

4. A bag drying rack as in claim 3 further comprising at least one positioning tab extending from each of said cross bars.

5. A bag drying rack comprising:

a tray shaped rack base having a floor and raised edges;

a front and rear cross bar pivotally attached to said edges of said tray shaped rack base;

a plurality of bag tines extending perpendicular from said front and rear cross bar; and a means of holding said bag tines in a biased upward position perpendicular to said tray shaped rack base.

6. A bag drying rack as in claim 5 wherein said left and right side of said tray forms a first and second elongate slot such that said front cross bar may slide within said first and second elongate slot.

7. A bag drying rack as in claim 6 further comprising a plurality of fasteners to attach said cross bars to said tray.

8. A bag drying rack as in claim 7 wherein said means of holding said bag tines in a biased upward position is at least one positioning tab extending from each of said cross bars.

9. A bag drying rack comprising:

a tray shaped rack base having a floor, a left and right side and a front and back end;

a front cross bar attached to said left and right side of said tray shaped rack;

a means of moving said front cross forward and backward with respect to said front and back end of said tray shaped rack base;

a rear cross bar attached to said left and right side of said tray shaped rack base; and a plurality of bag tines extending perpendicular from said front and rear cross bars.

10. A bay drying rack as in claim 9 wherein said front and rear cross bars are pivotally mounted to said tray shaped rack base.

11. A bag drying rack as in claim 10 wherein said means of moving said front cross bar is a first and second elongate slot formed in said left and right side of said tray shaped rack base such that said front cross bar may slide within said first and second elongate slot.

12. A bag drying rack as in claim 11 further comprising a plurality of fasteners to attach said cross bars to said tray.

13. A bag drying rack as in claim 12 further comprising at least one positioning tab extending from each of said cross bars.

* * * * *